US007465046B2

(12) United States Patent
Kojima

(10) Patent No.: US 7,465,046 B2
(45) Date of Patent: Dec. 16, 2008

(54) IMAGE FORMING APPARATUS

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 226 days.

(21) Appl. No.: 11/605,231

(22) Filed: Nov. 29, 2006

(65) Prior Publication Data

US 2007/0070167 A1 Mar. 29, 2007

Related U.S. Application Data

(62) Division of application No. 10/947,156, filed on Sep. 23, 2004, now Pat. No. 7,165,832.

(30) Foreign Application Priority Data

Sep. 24, 2003 (JP) ..... 2003-332463

(51) Int. Cl.
*B41J 2/01* (2006.01)

(52) U.S. Cl. ..... 347/101

(58) Field of Classification Search ..... 347/171, 347/223, 222, 101, 1, 18
See application file for complete search history.

(56) References Cited

U.S. PATENT DOCUMENTS

2004/0183879 A1* 9/2004 Nakazawa ..... 347/101
2005/0036022 A1 2/2005 Okamoto et al.
2005/0041053 A1* 2/2005 Hasebe et al. ..... 347/18
2005/0068399 A1 3/2005 Suzuki et al.
2005/0078145 A1 4/2005 Inoue
2005/0093919 A1 5/2005 Takatsuka et al.

FOREIGN PATENT DOCUMENTS

JP 9109377 A 4/1997

* cited by examiner

*Primary Examiner*—K. Feggins
(74) *Attorney, Agent, or Firm*—Birch, Stewart, Kolasch & Birch, LLP

(57) ABSTRACT

The image forming apparatus comprises: an image forming unit which forms an image by discharging droplets from a recording head onto a recording medium; a conveyance belt which conveys the recording medium, a surface of the conveyance belt facing the recording head being treated with a liquid repelling treatment in order to repel the droplets adhering to the surface of the conveyance belt; and a droplet discharge control device which causes the droplets to be deposited in substantially same droplet deposition positions on the surface of the conveyance belt from the recording head when performing a recovery operation for the recording head.

1 Claim, 6 Drawing Sheets

IMAGE FORMING APPARATUS

This application is a Divisional of application Ser. No. 10/947,156 filed on Sep. 23, 2004 now U.S. Pat. No. 7,165,832, and for which priority is claimed under 35 U.S.C. § 102; the entire contents of all are hereby incorporated by reference.

BACKGROUND OF THE INVENTION

1. Field of the Invention

The present invention relates to an image forming apparatus, and more particularly, to an image forming apparatus for carrying out nozzle cleaning of a recording head by preliminary discharge of ink onto a conveyance belt.

2. Description of the Related Art

An image forming apparatus based on an inkjet method forms images on recording paper by discharging ink onto recording paper from a recording head while conveying recording paper by means of a conveyance belt. In an image forming apparatus of this kind, in order to clean and prevent drying of the nozzles of the recording head which are in contact with the external air at all times, a preliminary discharge (purge, blank discharge, liquid discharge) is carried out from the nozzles, into an ink receiving part, at prescribed time intervals. However, there is a problem in that a separate ink receiving part is required. Japanese Patent Application Publication No. 9-109377 discloses technology to resolve this problem wherein an ink receiving section is provided on the conveyance belt, and furthermore, ink is removed from the ink receiving section by dropping off naturally when the ink receiving section of the conveyance belt is facing downwards.

In the image forming apparatus of this kind, however, if the amount of ink expelled in the preliminary discharge is a very small amount (for example, several picoliters), then the solvent component of the ink will evaporate very rapidly, and the ink will solidify on the conveyance belt, and hence the ink will not be readily removable (it will not readily drop off in a natural fashion).

Furthermore, in Japanese Patent Application Publication No. 9-109377, since the ink receiving part is formed in a particular position of the conveyance belt, there has been a problem in that preliminary discharge cannot be carried out at any desired position on the belt, and productivity in image forming declines.

SUMMARY OF THE INVENTION

The present invention has been devised with the foregoing situation in view, an object thereof being to provide an image forming apparatus whereby ink on a conveyance belt can be removed in a reliable manner, while also making it possible to improve productivity.

In order to attain the above-described object, the present invention is directed to an image forming apparatus, comprising: an image forming unit which forms an image by discharging droplets from a recording head onto a recording medium; a conveyance belt which conveys the recording medium, a surface of the conveyance belt facing the recording head being treated with a liquid repelling treatment in order to repel the droplets adhering to the surface of the conveyance belt; and a droplet discharge control device which causes the droplets to be deposited in substantially same droplet deposition positions on the surface of the conveyance belt from the recording head when performing a recovery operation for the recording head.

According to the present invention, since the droplet discharge control device is provided for causing droplets to be deposited in substantially the same droplet deposition positions on the belt surface, from the recording head, when performing a recovery operation (preliminary discharge) in the recording head, on the surface of a belt which has received a liquid repelling treatment, then droplets are repeatedly deposited so that these droplets can be combined on the surface of the belt. Thereby, it is possible to cause large droplets of cohering liquid to drop off naturally in a belt turning position, and hence the recoverability of the droplets can be improved. Furthermore, since the droplets can be deposited at any position on the surface of the belt, it is not necessary to distinguish the position of the recording paper with respect to the conveyance belt, and therefore, the productivity of the recording paper can be improved. More particularly, in a full line type head wherein a plurality of recording heads are disposed for ink colors, if ink droplets are caused to be repeatedly deposited in substantially the same droplet deposition positions from the respective recording heads of the respective colors, then the ink can be removed in a highly efficient manner.

The present invention is also directed to an image forming apparatus, comprising: an image forming unit which forms an image by discharging droplets from a recording head onto a recording medium; and a conveyance belt which conveys the recording medium, recess sections for collecting the droplets being formed on a surface of the conveyance belt facing the recording head, the surface of the conveyance belt facing the recording head being treated with a liquid repelling treatment in order to repel the droplets adhering to the surface of the conveyance belt, wherein the droplets are combined in the recess sections when performing a recovery operation for the recording head.

According to the present invention, since the droplets can be gathered in droplet gathering recess sections formed in the surface of the conveyance belt, it is possible to promote coalescence and aggregation of the droplets, and hence the droplet gathering efficiency can be improved. The shape of these recess sections may be a dimple shape, or a groove shape, or the like, for example, in order to combine and aggregate droplets deposited by preliminary discharge in a highly efficient manner.

The present invention is also directed to an image forming apparatus, comprising: an image forming unit which forms an image by discharging droplets from a recording head onto a recording medium; a conveyance belt which conveys the recording medium, a surface of the conveyance belt facing the recording head being treated with a liquid repelling treatment in order to repel the droplets adhering to the surface of the conveyance belt, the conveyance belt being guided to have a bent section of the conveyance belt; and a guide roller which is disposed in the bent section and guides the droplets.

According to the present invention, it is possible to aggregate droplets in the bent section of the conveyance belt. Moreover, since the guide roller for guiding the droplets is disposed in the bent section, it is possible to remove the droplets aggregated in the bent section by means of the rotation of the guide roller accompanying the driving of the conveyance belt. In particular, if a spiral shaped groove for guiding the liquid is formed in the guide roller, then an extruding action caused by the spiral groove will be generated in the liquid inside the spiral groove, as the guide roller is rotated, and hence the droplets inside the spiral groove will be expelled along the guide roller and will be removed from the surface of the conveyance belt.

The present invention is also directed to an image forming apparatus, comprising: an image forming unit which forms an image by discharging droplets from a recording head onto a recording medium; and a conveyance belt which conveys the recording medium, the conveyance belt being inclined to an angle of 1 to 10 degrees with respect to horizontal plane, in a direction orthogonal to a conveyance direction of the recording medium.

According to the present invention, since the conveyance belt is inclined at an angle of 1 to 10 degrees with respect to the horizontal plane, in a direction orthogonal to the conveyance direction of the recording medium, then it is possible to remove the droplets adhering to the surface of the belt by causing same to flow down off the belt surface.

Moreover, in the present specification, the term "recording" indicates the concept of forming images in a broad sense, including text. Moreover, "recording medium" indicates a medium which receives a printing action by means of a recording head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and other materials.

According to the present invention, droplets on a conveyance belt can be removed in a reliable manner, and furthermore, productivity can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, a first embodiment of an image forming apparatus according to the present invention is described with reference to the accompanying drawings.

Figure 1:
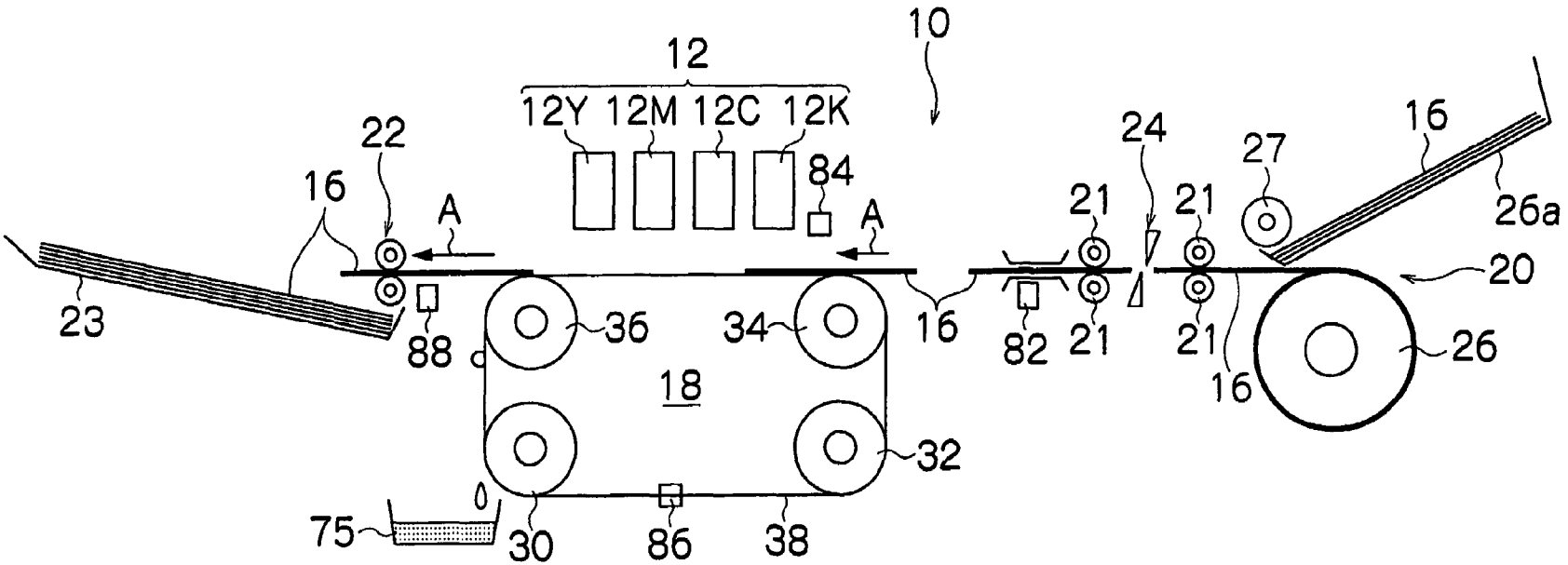
FIG. 1 is a side view showing an image forming apparatus according to an embodiment of the present invention.

FIG. 1 is a diagram of the general composition of an image forming apparatus according to the first embodiment of the present invention. This image forming apparatus 10 comprises: a recording head 12 including recording heads 12K, 12C, 12M and 12Y provided for each of ink colors, black (K), cyan (C), magenta (M) and yellow (Y); a belt conveyance unit 18, disposed in a position opposing the recording head 12, for conveying recording paper 16 on a belt 38 while holding the recording paper 16 in a flat state; a paper supply unit 20 for supplying the recording paper 16; and a paper output unit 22 for outputting the recording paper 16 whereon an image has been formed, from inside the apparatus to outside the apparatus.

The recording head 12 is a so-called full line type head, wherein a line type head having a length corresponding to the width of the recording paper 16 is disposed, in a direction orthogonal to the paper conveyance direction.

A paper roll (continuous paper) 26 is set in place detachably in the paper supply unit 20. The single paper roll 26 is set in the paper supply unit 20 in the present embodiment; however, it is also possible to adopt a composition wherein a plurality of rolls of different paper widths and paper qualities, or the like, are used in parallel with the paper roll 26. Furthermore, it is also possible to supply cut paper by means of a cassette 26A wherein cut paper sheets are stacked and loaded, either instead of the paper roll 26 in parallel with same. Each cut paper sheet is conveyed from the cassette 26A with a supply roller 27.

Pickup rollers 21 for picking up recording paper 16 from the paper roll 26 are provided in the vicinity of the paper supply unit 20. The driving force of a motor 109 (not shown in FIG. 1, but shown in FIG. 3) is transmitted to at least one of the pick-up rollers 21, and the recording paper 16 picked up thereby is conveyed from right to left in FIG. 1. The recording paper 16 picked up from the roller paper 26 is cut to a prescribed size by means of a shearing cutter 24 disposed between the rollers 21. A composition may also be adopted wherein a decurling processing unit (not shown) is disposed on the upstream side of the cutter 24 in the vicinity thereof, for removing curling in the recording paper 16 due to its being wound as the paper roll 26.

Figure 2:
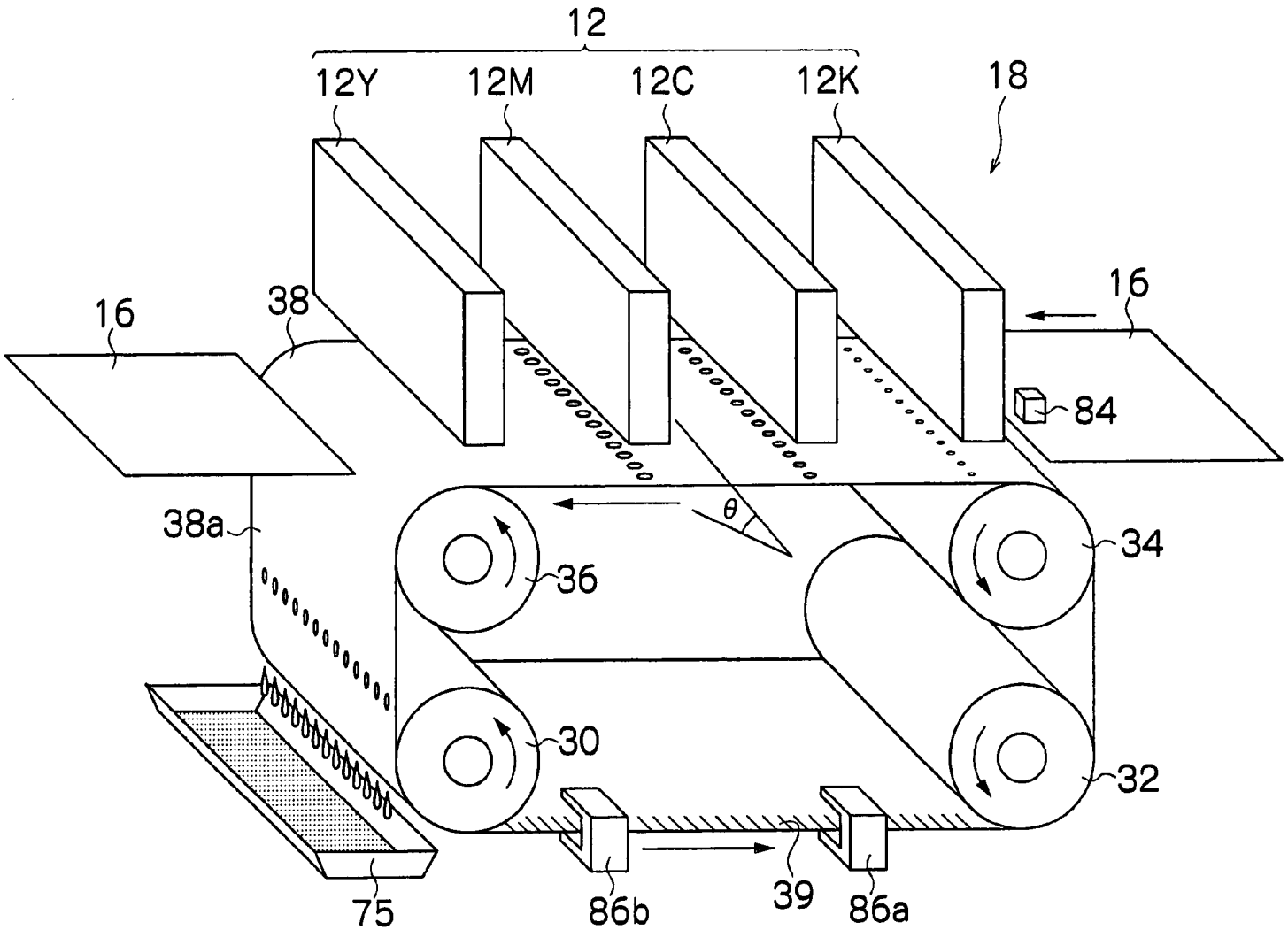
FIG. 2 is an oblique view of a belt conveyance unit used in the image forming apparatus.

The belt conveyance unit 18 has a structure wherein the endless belt 38 is wound about rollers 30, 32, 34 and 36, as shown in FIG. 2, and is composed in such a manner that at least the portion opposing the recording head 12 is a horizontal surface (flat surface). The driving force of a motor 108 (not shown in FIG. 1, but shown in FIG. 3) is transmitted to at least one of the rollers 30, 32, 34 and 36, about which the belt 38 is wound.

The belt 38 has a width broader than that of the recording paper 16, and the surface of the belt 38 is processed with a liquid repelling treatment. The liquid repelling treatment of the belt surface generally imparts the belt 38 with liquid repelling properties of a degree whereby the ink can move readily, and desirably, for example, the angle of contact of the ink droplet with respect to the belt surface becomes 120° or above.

A recording paper detection unit 82 determines the position and size of the recording paper 16. A recording position detection unit 84 determines the timing of ink discharge onto the recording paper 16. A phase determination unit 86 determines the phase of the belt 38. A recording paper trailing edge detection unit 88 detects blockage of the recording paper 16 and determines the timing at which the next sheet is to be supplied. A paper output tray 23, or the like, for stacking sheets of recording paper 16 on which images have been formed is provided in the paper output unit 22. An ink receptacle tray 75 collects the ink that has been deposited onto the belt 38 from the recording head 12.

As shown in FIG. 2, the phase determination unit 86 in the present embodiment is actually composed of two phase determination units 86*a* and 86*b*. The belt 38 is driven in the counterclockwise direction in the FIG. 2, and the recording paper 16 on the belt 38 is conveyed from right to left in FIG. 2. A linear scale 39 is arranged on the belt 38 as shown in FIG. 2, and the phase determination units 86*a* and 86*b* determine the phase of the belt 38 by reading the linear scale 39. The linear scale 39 is arranged on the inner surface of the belt 38 in FIG. 2; however, the linear scale 39 may be arranged on the outer surface of the belt 38 instead. The first phase determination unit 86*a* detects the origin on the belt 38, and the second phase determination unit 86*b* reads the linear scale 39. Instead of the second phase determination unit 86*b*, a rotary encoder (not shown) may be arranged to one of the rollers 30, 32, 34 and 36, so that the phase of the belt 38 is determined through the rotary encoder.

Figure 3:
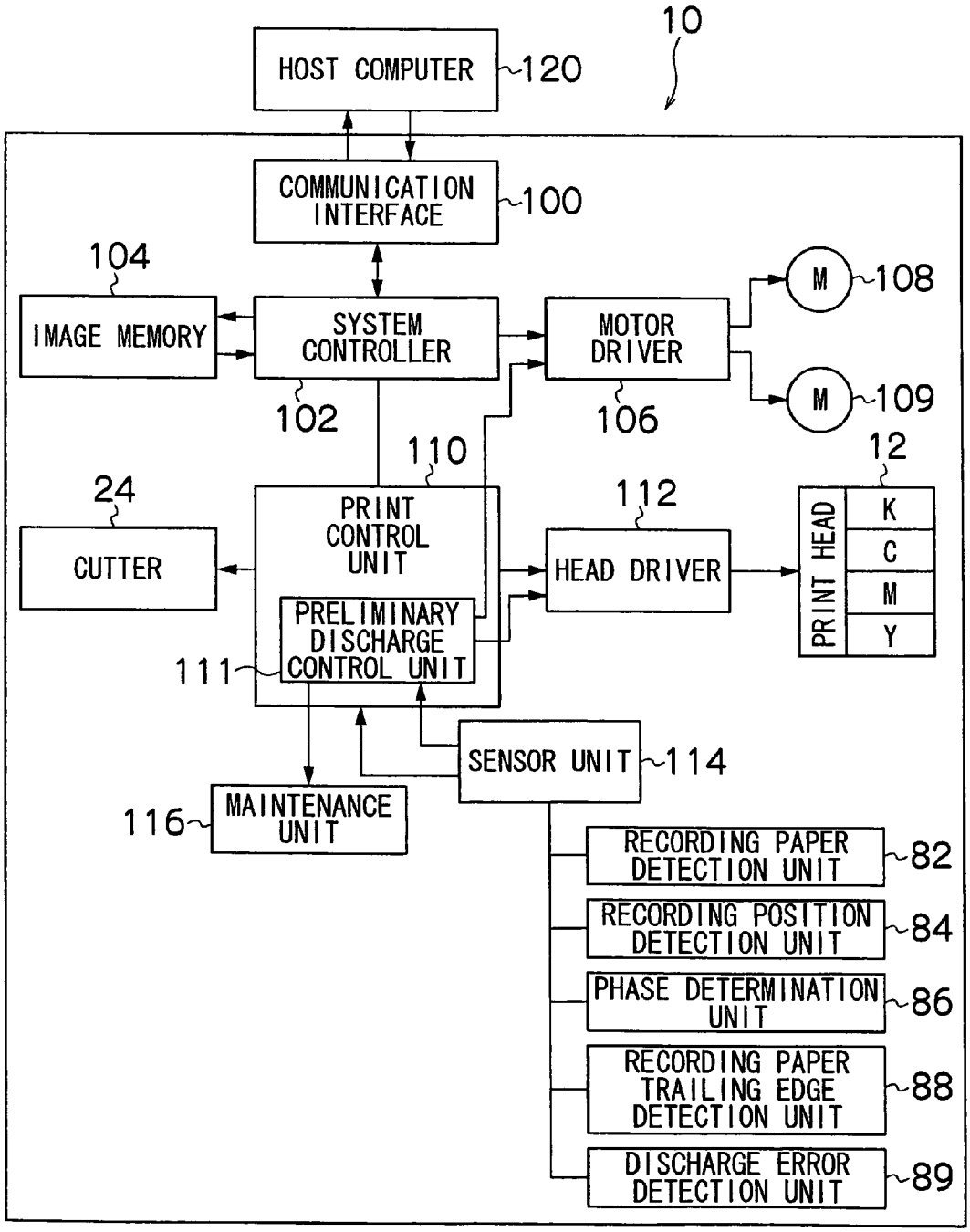
FIG. 3 is a principal block diagram showing the system composition of the image forming apparatus.

The phase determination unit 86 (and the rotary encoder if any) sends signals representing the phase of the belt 38 to a print controller 110 (a preliminary discharge controller 111) shown in FIG. 3, which can control the ink discharge from the print head 12 according to the phase signals so as to deposit ink droplets on the substantially same position on the belt 38.

FIG. 3 is a principal block diagram showing the system composition of the image forming apparatus 10. The image forming apparatus 10 comprises a communication interface 100, a system controller 102, a print control unit 110, a head driver 112, a sensor unit 114, the cutter 24, and so on.

The communication interface 100 is an interface unit for receiving image data transmitted from a host computer 120. For the communication interface 100, a serial interface, such as USB, IEEE 1394, the Internet, or a wireless network, or the like, or a parallel interface, such as Centronics, or the like, can be used. Image data sent from the host computer 120 is read into the image forming apparatus 10 via the communication interface 100, and it is stored temporarily in an image memory 104. The image memory 104 is a storage device for temporarily storing inputted image data, and reading and writing of the image data is carried out via the system controller 102.

The system controller 102 is a control unit for controlling the various sections, such as the communication interface 100, the image memory 104, a motor driver 106, and so on. The system controller 102 includes a central processing unit (CPU) and peripheral circuits relating to same, and the like, and in addition to controlling communication with the host computer 120 and controlling reading and writing of the image memory 104, or the like, it also generates control signals for controlling conveyance of the recording paper 16 by means of motors 108, 109, and the like.

The motor driver 106 is a driver (drive circuit) which drives the motors 108, 109 in accordance with instructions from the system controller 102.

The print control unit 110 is a control unit for controlling various sections, such as the head driver 112, the cutter 24, and the like, according to the detection results outputted from the sensor unit 114. In accordance with the control implemented by the system controller 102, the print control unit 110 performs various treatment processes, and the like, in order generate a signal for controlling image formation, from the image data in the image memory 104, and it supplies the image formation control signal (image data) thus generated to the head driver 112. The head driver 112 drives the recording heads corresponding to various colors (K, C, M and Y) in the recording head 12 according to the image data supplied from the print control unit 110.

The print control unit 110 is provided with a preliminary discharge control unit 111 for controlling recovery operation of the recording head 12 including preliminary discharge operation. The preliminary discharge control unit 111 controls the units concerned such as the motor driver 106, the head driver 112 and a maintenance unit 116, according to the detection results outputted from the sensor unit 114.

The maintenance unit 116 includes a wiping unit and a suction unit. The wiping unit is composed of a cleaning blade for wiping the nozzle face of the recording head 12, and a driving mechanism for driving the cleaning blade. The suction unit brings a cap in close contact with the nozzle face of the recording head 12, and removes ink inside the recording head 12 (the pressure chambers 52) by suction with a suction pump.

The sensor unit 114 provided in the print control unit 110 is a block comprising the aforementioned recording paper detection unit 82, the recording position detection unit 84, the phase determination unit 86, the recording paper trailing edge detection units 88 and a discharge error detection unit 89, and the detection results obtained by these various detection units are supplied to the print control unit 110 and the preliminary discharge control unit 111. In the print control unit 110 including the preliminary discharge control unit 111, prescribed computational processes are carried out according to the detection results obtained by the respective detection units, and the processed results are supplied to the system controller 102. More specifically, the timing at which the recording paper 16 is cut by the cutter 24, and the like, is determined according to the detection results outputted from the recording paper detection unit 82, and the timing at which ink is discharged, and the like, is determined according to the detection results outputted from the recording position detection unit 84. Moreover, the drive position of the belt 38 is determined according to the detection results outputted from the phase determination unit 86, and judgment of blockages of the recording paper 16, and the timing at which the next sheet is to be supplied, and the like, are determined according to the detection results outputted from the recording paper trailing edge detection unit 88. Furthermore, the preliminary discharge control unit 111 performs control for carrying out a nozzle cleaning operation for cleaning the nozzles as described hereinafter, at predetermined time intervals or after a certain number of recording operations. The preliminary discharge control unit 111 also performs control for carrying out the nozzle cleaning operation (and the recovery operation by the maintenance unit 116, if necessary) in cases where the occurrence of a nozzle error has been detected, according to the detection results outputted from the discharge error detection unit 89 shown in FIG. 3.

Next, the action of the image forming apparatus 10 having the foregoing composition will be described.

In FIG. 3, the image data to be printed is inputted from the host computer 120 through the communication interface 100, and the inputted image data is stored in the image memory 104. The system controller 102 drives the motor 109 (108) through the motor driver 106, the recording paper 16 is picked up from the paper roll 26 illustrated in FIG. 1 and it is conveyed to the cutter 24. The system controller 102 causes the cutter 24 through the print control unit 110 to cut the recording paper 16 to a predetermined paper size in accordance with the image data, and the cut recording paper 16 is transported to the belt conveyance unit 18. Thereupon, the system controller 102 controls the rotation of rollers 30, 32, 34 and 36 according to the detection results outputted from the sensor unit 114. Thereby, the recording paper 16 is conveyed on the belt 38.

When the recording paper 16 thus conveyed arrives at the recording head 12, recording onto the recording paper 16 is carried out. More specifically, the image data stored in the image memory 104 in FIG. 3 is supplied to the print control unit 110, and the image data is converted into data for dots of the respective ink colors, by means of the head driver 112. The head driver 112 reads in the dot data, and generates a drive control signal for the recording head 12. By supplying the drive control signal generated by the head driver 112 to the nozzles of the recording head 12, ink is discharged from the nozzles onto the recording surface of the recording paper 16.

The ink discharge timing from the recording head 12 is controlled in synchronism with the conveyance speed of the recording paper 16, according to the detection results outputted from the recording position detection unit 84 of the sensor unit 114, so that the recording head 12 can form an image on the recording paper 16 without halting the conveyance of the recording paper 16. The recording paper 16 whereon the image has been recorded is continuously conveyed by the belt 38 and is outputted from the paper output unit 22.

Next, preliminary discharge is described. During printing, or during standby, if the use frequency of a particular nozzle is low, and if it continues in a state of not discharging ink for a prescribed time period or more, then the solvent in the ink in the vicinity of the nozzle evaporates and the viscosity of the ink increases. When a state of this kind arises, then even if the actuator (not illustrated) of the recording head 12 is operated, it will not be possible to discharge ink from the nozzles. Before this state arises, the actuator is operated while the ink is still of a dischargeable viscosity, and preliminary discharge is carried out in such a manner that the degraded ink (ink in the vicinity of the nozzle having increased viscosity) is expelled.

When a predetermined time interval of a non-operating nozzle has elapsed or when a certain number of recording operations have been performed, or if a discharge error is detected by means of the discharge error detection unit 89 in FIG. 3, then preliminary discharge is carried out as described below.

More specifically, if recording operations are carried out in a continuous fashion until a prescribed period of time or a prescribed number of recording operations is reached, or if the existence of a discharge error in the nozzles has been detected by the discharge error detection unit 89, then the print control unit 110 detects the leading edge of the recording paper 16 that is to be conveyed next by the recording paper detection unit 82 (see FIG. 1), and when the trailing edge of the recording paper 16 that is currently being conveyed has passed a position opposing the recording head 12K for discharging black ink, ink which does not contribute to printing is discharged from all of the nozzles in the recording head 12K, by means of the head driver 112. More specifically, the conveyance interval between the trailing edge of the recording paper 16 currently being conveyed and the leading edge of the recording paper 16 that is to be conveyed subsequently is used in order to discharge ink that does not contribute to printing, from all of the nozzles of the recording head 12K, onto the belt 38 in the gap between the paper sheets, when the interval (gap) between the respective sheets of recording paper 16 is situated in a position opposing the recording head 12. The ink expelled in the preliminary discharge is deposited onto the belt 38, and thereby, defective ink which has dried out due to lack of use, or which has changed viscosity, is removed from the nozzles of the recording head 12K.

After carrying out the preliminary discharge by means of the recording head 12K in this way, as the position between paper sheets moves successively to positions opposing the recording heads 12C, 12M and 12Y, a similar preliminary discharge operation is carried out by the recording head corresponding to each color, by discharging ink which does not contribute to printing from the respective recording heads 12C, 12M and 12Y, towards the portion of the belt 38 between the paper sheets. In this case, the preliminary discharge control unit 111 of the print control unit 110 controls the ink discharge timing in such a manner that ink droplets discharged from the other recording heads 12C, 12M and 12Y are deposited at substantially the same droplet deposition points as those where the ink droplets discharged from the recording head 12K have been deposited on the belt 38. More specifically, according to the detection results outputted from the phase determination unit 86, the recording heads 12C, 12M and 12Y are controlled to discharge ink droplets so that the ink droplets are repeatedly deposited at substantially the same droplet deposition points where the ink droplets have been deposited on the belt 38 when discharged from the recording head 12K. Thereby, the ink droplets of the colors can cohere to form masses on the belt 38.

Then, the ink masses thus combined are driven in rotation with the belt 38, as the belt 38 is driven, and the ink masses are conveyed to a belt turning position 38*a*. Thereupon, as shown in FIG. 1, the ink adhering to the belt 38 drops off naturally in the belt turning position, and hence is removed from the surface of the belt 38 and collected in the ink receptacle tray 75. Here, the belt direction is turned through an angle of approximately 90° in FIGS. 1 and 2, but provided that the belt is turned downwards, any angle may be adopted.

In this way, according to the image forming apparatus 10 of the present embodiment, the ink droplets discharged by preliminary discharge operations can be repeatedly deposited at substantially the same droplet deposition points as those where the ink droplets discharged by a previous preliminary discharge operation have been deposited, on the surface of the belt 38 which has undergone liquid repelling treatment, and therefore the ink droplets can combine into large masses on the belt surface. Consequently, it is possible to remove these large combined masses of ink by means of their dropping off naturally due to the effects of the liquid repelling treatment of the belt surface, in the turning position of the belt 38, and the recoverability of the ink is thereby improved.

Moreover, since preliminary discharge can be carried out at any position on the belt 38, then it becomes possible to perform preliminary discharge at any desired position of the belt, and hence the productivity in image forming on the recording paper can be improved.

Next, a second embodiment of an image forming apparatus according to the present invention is described.

The image forming apparatus according to the second embodiment has a different composition for the belt 38 in the belt conveyance unit 18 of the image forming apparatus 10 described above, and the remaining composition thereof is virtually the same as that of the image forming apparatus 10 relating to the first embodiment described above, and hence detailed description of parts other than the belt conveyance unit is omitted here.

Figure 4A:
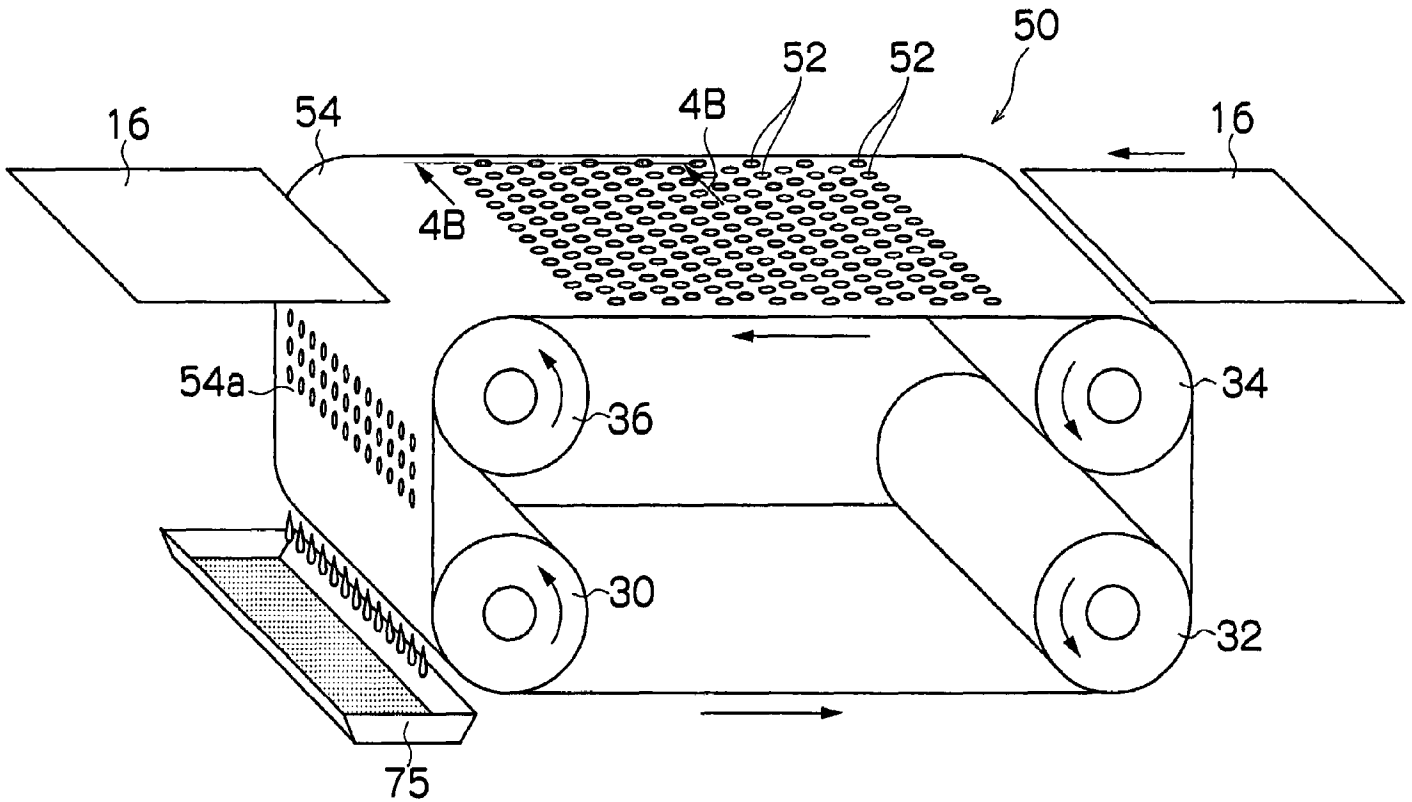
FIG. 4A is a perspective view showing another embodiment of a belt conveyance unit used in the image forming apparatus.
Figure 4B:
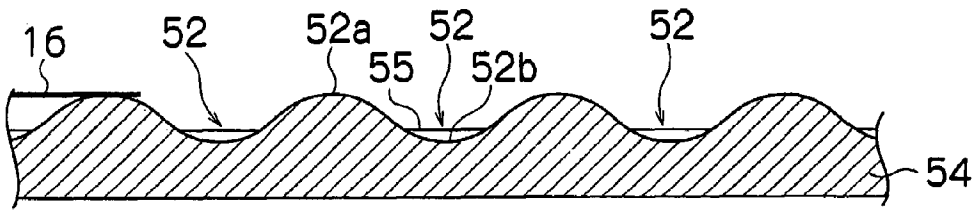
FIG. 4B is a sectional view taken along the line 4B-4B in FIG. 4A.

As shown in FIG. 4A, the belt conveyance unit 50 used in the image forming apparatus according to the second embodiment has a structure wherein an endless belt 54 having a plurality of dimples 52 formed on the surface of the belt facing towards the recording head 12 is wound about the rollers 30, 32, 34 and 36. The belt 54 has a width dimension broader than that of the prescribed maximum size of the recording paper 16, and the surface is processed with a liquid repelling treatment. As shown in FIG. 4B, the dimples 52 are formed in a wave-like shape wherein the 4B-4B cross-section comprises connected peak sections 52*a* and valley sections 52*b*, and are also formed with a similar wave shape in the direction perpendicular to the line 4B-4B.

The top part of the peak section 52*a*, which makes contact with the recording paper 16, is formed to a relatively flat shape in comparison to the bottom part of the valley section 52*b*. The inner faces of these dimples 52 are processed with a liquid repelling treatment.

The ink droplets that have been deposited onto the surface of the belt 38 flow into the valley sections 52*b* of the dimples 52, and then cohere as indicated with a reference numeral 55 in the bottom portions of the valley sections 52*b*. Thus, by means of the dimples 52, the coalescence and aggregation of the ink deposited onto the belt surface can be promoted, and hence the ink deposited onto the surface of the belt 38 can be made combine in the valley sections 52*b* even if there is only a very small amount of ink. Thereafter, the ink thus combined is driven in rotation with the belt 54, as the belt 54 is driven, and it is conveyed to a belt turning position 54*a*. Then, the ink adhering to the belt 54 drops off naturally in the belt turning position 54*a*, and hence is removed from the surface of the belt 54 and collected in the ink receptacle tray 75.

According to the image forming apparatus having a composition of this kind, it is possible to promote coalescence and aggregation of ink by means of the recess sections for combining ink droplets formed in the surface of the belt 54, and hence the ink gathering efficiency can be improved.

By disposing the plurality of dimples 52 in a staggered matrix arrangement and by using the phase determination unit 86, it is possible to cause the ink droplets from all of the nozzles to be discharged in preliminary discharges, into the dimples 52, and to be gathered in same.

Figure 5A:
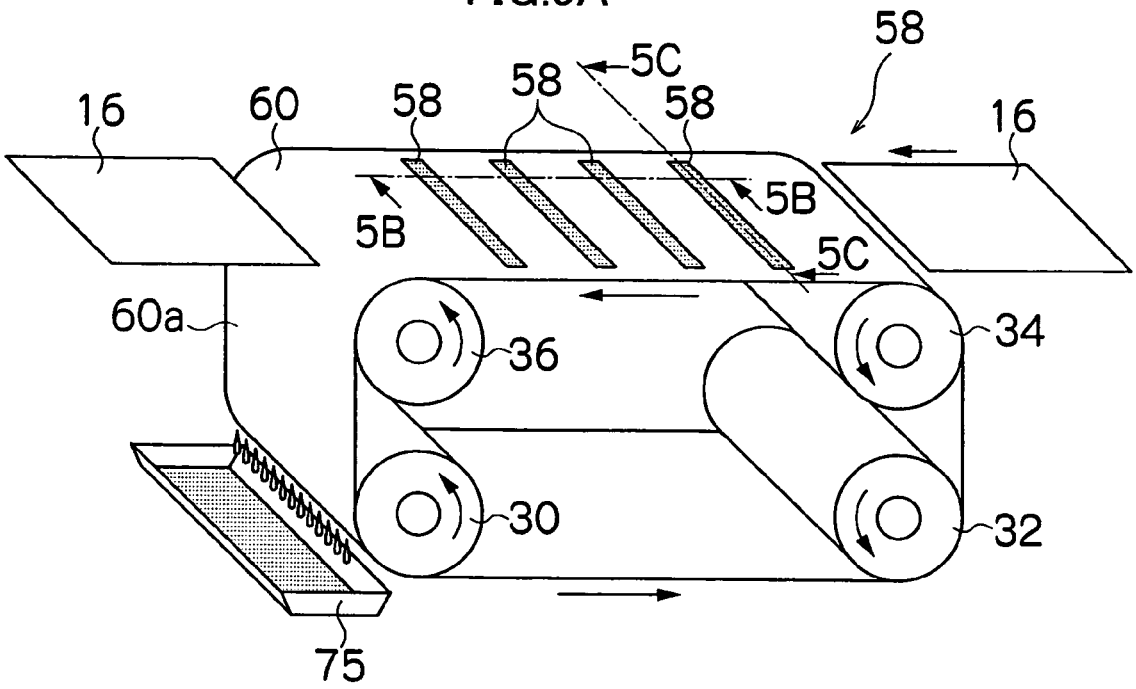
FIG. 5A is a perspective view showing another embodiment of a belt conveyance unit.
Figure 5B:
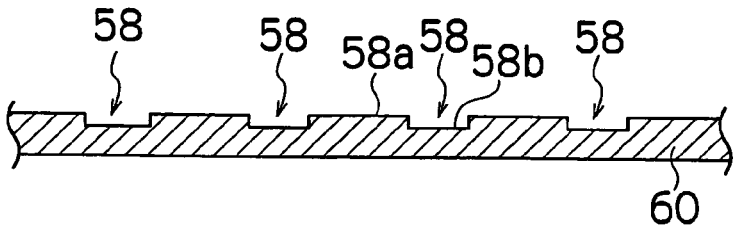
FIG. 5B is a sectional view taken along the line 5B-5B in FIG. 5A.
Figure 5C:
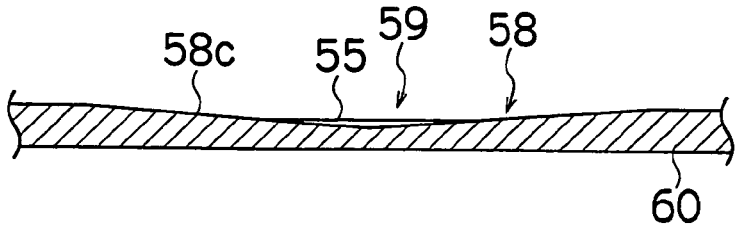
FIG. 5C is a sectional view taken along the line 5C-5C in FIG. 5A.

Here, the composition of the recess sections for gathering the ink formed in the belt surface are not limited to the dimples 52 described above, and for example, it is also possible to form grooves 58 in a direction substantially orthogonal to the conveyance direction, as in a belt 60 of a belt conveyance unit 56 shown in FIG. 5A. These grooves 58 are formed in such a manner that the 5B-5B cross-section has a square waveform comprising connected peak sections 58*a* and valley sections 58*b*, as shown in FIG. 5B, and in the 5C-5C cross-section in the orthogonal direction to the conveyance direction, the bottom face 58*c* of each groove 58 is inclined toward the approximate center of the belt 60, as shown in FIG. 5C, thereby forming a liquid collecting region 59. Thereby, the ink deposited into the grooves 58 on the belt 60 from the recording head 12 is encouraged to coalesce and aggregate as indicated with the reference numeral 55 in the liquid collecting region 59, and hence the ink gathering efficiency is improved.

Figure 5D:
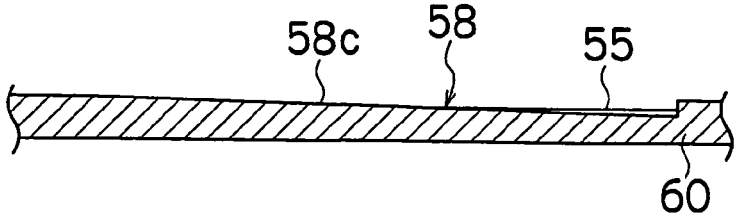
FIG. 5D is a sectional view corresponding FIG. 5C showing a modification of a groove on the belt.

As shown in FIG. 5D, the composition of the bottom face 58*c* of each groove 58 may also be such that, in the cross-section in the direction orthogonal to the conveyance direction (i.e., corresponding to the 5C-5C cross-section), the bottom face 58*c* is inclined toward the end portion on one side in the widthwise direction of the belt 60. By means of grooves 58 having this composition, the ink deposited into the grooves 58 can combine in the end portion on one side of each groove 58.

Figure 6A:
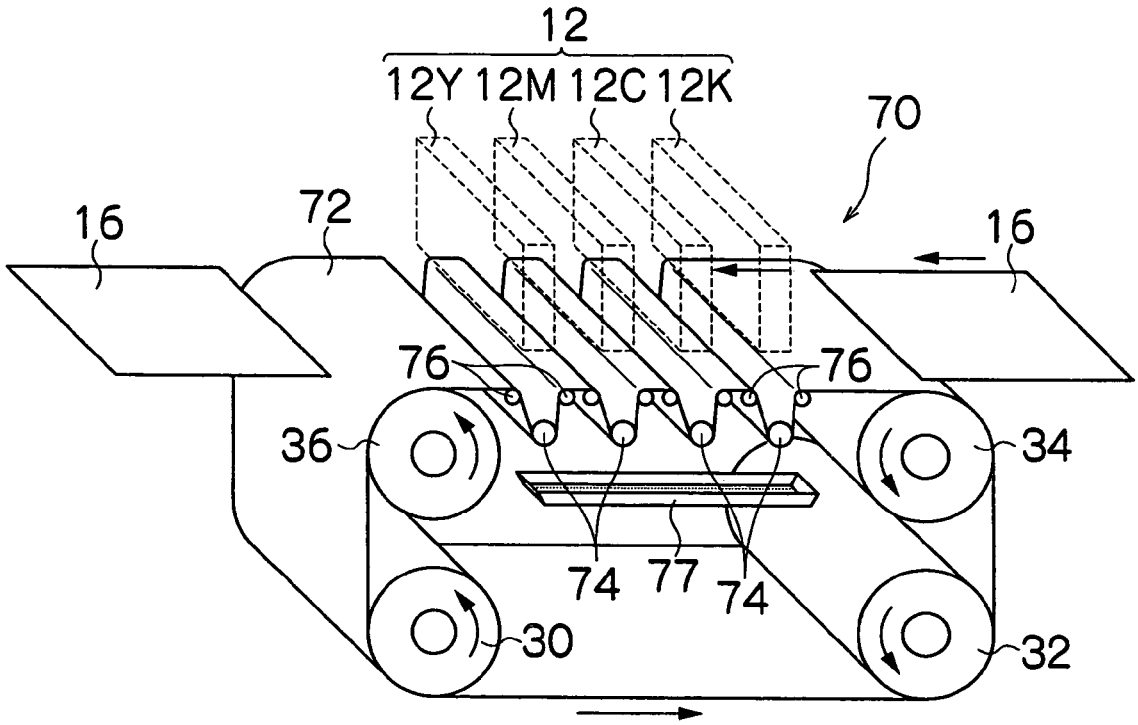
FIG. 6A is a perspective view showing another embodiment of a belt conveyance unit.
Figure 6B:
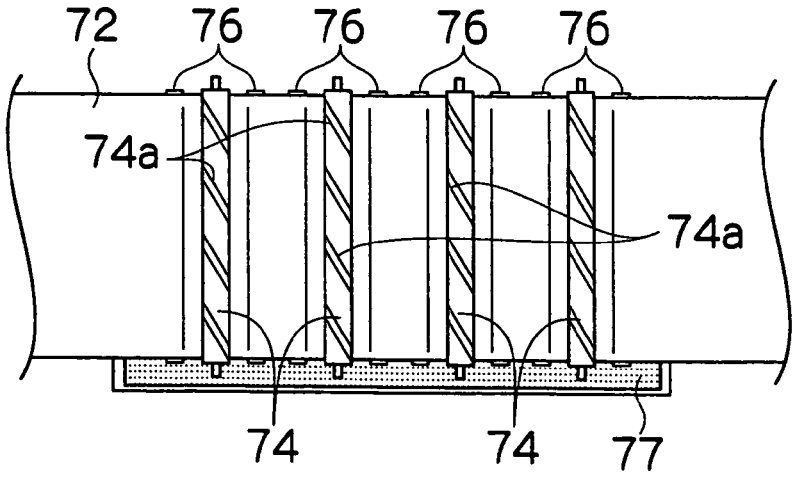
FIG. 6B is a top view of FIG. 6A.

Next, a third embodiment of an image forming apparatus according to the present invention is described, with reference to FIGS. 6A and 6B.

The image forming apparatus according to the third embodiment of the present invention has a different composition for the belt conveyance unit 18 of the image forming apparatus 10 described above, and the remaining composition thereof is virtually the same as that of the image forming apparatus 10 according to the first embodiment described above.

As shown in FIG. 6A, the belt conveyance unit 70 used in the image forming apparatus according to the third embodiment is composed of a belt 72 wound about the rollers 30, 32, 34, 36, and guide rollers 74, auxiliary rollers 76, and the like, which cause the belt 72 to bend.

The belt 72 has a width dimension broader than that of the recording paper 16, and the surface is processed with a liquid repelling treatment. The guide rollers 74 and the auxiliary rollers 76 are respectively supported rotatably from the main body of the image forming apparatus. The auxiliary rollers 76 form the belt 72 into a flat surface in a position below the recording head 12. The guide rollers 74 cause the belt 72 to bend, via the auxiliary rollers 76, in positions opposing the recording head 12. Ink is collected in the bend sections of the belt 72 having this composition. Furthermore, the recording paper 16 conveyed to the belt conveyance unit 70 is conveyed while making contact with the flat surfaces of the belt 72 in the upper portion of the belt conveyance unit 70.

As shown in FIG. 6B, a spiral groove 74*a* is formed on the circumferential surface of each guide roller 74, and the ink aggregated in the bend sections of the belt 72 enters into the spiral grooves 74*a*. The ink that has dropped from the end portions of the guide rollers 74 is collected in an ink receptacle tray 77.

To describe the action of the image forming apparatus having the composition described above, ink is discharged by preliminary discharge, from the recording head 12, and into the bend sections of the belt 72. When the guide rollers 74 of the bend sections are rotated, the ink in the bend sections is pushed out from the belt 72, along the spiral grooves 74*a*, by means of the extruding action of the spiral grooves 74*a*. Then, the ink drops from the end portions of the guide rollers 74 and is collected in the ink receptacle tray 77.

It is preferable to dispose the bend sections in a downstream position with respect to the position opposing the heads (in the vicinity of the heads), and on the opposite side of the recording paper conveyance path from the heads.

In this way, according to the image forming apparatus according to the present embodiment, it is possible to expel ink inside the bend sections, along the guide rollers 74, and hence ink can be removed from the bend sections of the belt 72.

In the belt conveyance unit in an image forming apparatus according to a fourth embodiment of the present invention, the belt conveyance unit 18 shown in FIG. 2A is inclined to an angle θ of 1 to 10 degrees with respect to the horizontal plane, in the direction orthogonal to the conveyance direction. By this configuration, since the recording head 12, the belt 38, and the rollers 30, 32, 34 and 36, and the like, are inclined, any ink deposited on the surface of the belt 38 can be caused to drop off from the belt surface, due to the inclination thereof. Since both the recording head 12 and the belt 38 are inclined at the same angle θ of inclination, the clearance between the recording head 12 and the recording paper 16 can be maintained at a uniform value, no deviation occurs in the timing of droplet deposition of the ink discharged from the recording head 12, onto the recording paper 16, and hence decline in image quality can be prevented. The angle θ of inclination is set to 1 to 10 degrees, in order to prevent hindrance to the discharge of ink from the recording head 12. Thereby, it is possible to achieve both ink discharge performance and ink recovery performance, at the same time.

Furthermore, it is also possible to adopt a composition wherein, in the belt turning position 38*a* in FIG. 2, when the belt 38 is facing downwards, a processing liquid composed of water, or alcohol, or another liquid in which ink is soluble is discharged from nozzles (not illustrated), onto the belt 38, and the ink on the belt 38 is thereby washed away. A composition may also be adopted wherein the processing liquid is discharged onto the belt 38 from the recording head 12. Moreover, a composition may also be adopted wherein a special head for discharging the processing liquid is provided on the downstream side of the recording head 12, in the conveyance direction. Furthermore, a structure may also be adopted wherein ink, or ink and a processing liquid, are wiped by a blade composed of an elastic member, such as rubber, or the like, on the downward facing portion.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an image forming unit which forms an image by discharging droplets from a recording head onto a recording medium; and a conveyance belt which conveys the recording medium, the conveyance belt being inclined to an angle of 1 to 10 degrees with respect to horizontal plane, in a direction orthogonal to a conveyance direction of the recording medium.

* * * * *